US006487832B1

(12) United States Patent
Salicini

(10) Patent No.: US 6,487,832 B1
(45) Date of Patent: Dec. 3, 2002

(54) APPARATUS FOR WRAPPING CONFECTIONERY PRODUCTS AND THE LIKE

(75) Inventor: Sandro Salicini, Monterenzio (IT)

(73) Assignee: Bugnion S.p.A., Bologna (IT)

( * ) Notice: Subject to any disclaimer, the term of this patent is extended or adjusted under 35 U.S.C. 154(b) by 0 days.

(21) Appl. No.: 09/517,184

(22) Filed: Mar. 2, 2000

(30) Foreign Application Priority Data

Mar. 4, 1999 (IT) ..... BO99A0098

(51) Int. Cl.[7] ..... B65B 11/06

(52) U.S. Cl. ..... 53/228; 53/225; 53/234; 53/254

(58) Field of Search ..... 53/228, 234, 225, 53/254

(56) References Cited

U.S. PATENT DOCUMENTS

| | | | | | |
|---|---|---|---|---|---|
| 3,988,876 | A | * | 11/1976 | Seragnoli | 53/234 |
| 4,020,608 | A | * | 5/1977 | Seragnili | 53/201 |
| 4,768,639 | A | * | 9/1988 | Gamberini et al. | 198/392 |
| 5,519,981 | A | * | 5/1996 | Fukusaki | 221/233 |
| 6,070,387 | A | * | 6/2000 | Salicini | 53/227 |

FOREIGN PATENT DOCUMENTS

| | | |
|---|---|---|
| EP | 0 819 606 | 1/1998 |
| FR | 1.174.739 | 3/1959 |
| GB | 814470 | 6/1959 |

OTHER PUBLICATIONS

European Abstract, 00830146.7.

* cited by examiner

*Primary Examiner*—Rinald I. Rada
*Assistant Examiner*—Christopher Harmon
(74) *Attorney, Agent, or Firm*—The Law Offices of Timothy J. Klima

(57) ABSTRACT

The apparatus for wrapping confectionery products and the like comprises a device for feeding the products to be wrapped, an organ for extracting such products from the aforesaid feeding device able to co-operate with a device dispensing a piece of material in sheet form, a wrapping head with pincers, rotating according to a horizontal axis to bring individual products with a respective piece of material in sheet form in correspondence with a series of operative stations. The feeding device comprises a circular disk, positioned horizontally and rotating about a vertical axis, which presents, peripherally distributed, a series of recesses for the reception of respective products, open outwards, each provided, in correspondence with the lower surface of said disk and posteriorly thereto, with a related slit. Below said rotating disk is positioned an annulus, fastened to the structure of the apparatus, for supporting the products introduced into the aforesaid recesses, able partially to hide said slit of the recesses during the feeding phase. The annulus is so shaped as to distance itself from the rotating disk, in correspondence with a station for transferring the individual products to be wrapped to the wrapping head, to render visible said slit during the transfer phase and allow means for thrusting said extractor organ to transit through it.

7 Claims, 7 Drawing Sheets

30
33
6
35
5
34
36
4
37
2
37
16
14
38
39
40

APPARATUS FOR WRAPPING CONFECTIONERY PRODUCTS AND THE LIKE

BACKGROUND OF THE INVENTION

The present invention relates to an apparatus for wrapping confectionery products and the like, in particular candies.

Wrapping machines are currently known which automatically wrap confectionery products. In particular, wrapping machines are known which comprise a device for feeding the products to be wrapped and a wrapping head with pincers, positioned above the feeding device, rotating according to a horizontal axis for bring the aforesaid products, together with a respective piece of material in sheet form, in correspondence with a series of operative stations, in turn located above the feeding devices.

The feeding device is constituted for instance by a disk rotating about a vertical axis. The individual products to be wrapped are provided to respective recesses, distributed along the periphery of the feeding disk. The products fed by means of the disk device are transferred upwards in succession from the related recesses into one of the pincers of the wrapping head which envelops and encloses around them the respective piece of material in sheet form.

The transfer of the products from the feeding device to the wrapping head is effected, in a related operative station, by an extractor organ which is able to co-operate with a device for dispensing the aforementioned piece of material in sheet form. In an active stroke, the extractor organ engages the feeding device so as to draw the product to be wrapped and transfer it, together with the related piece of material in sheet form, to a corresponding set of pincers of the wrapping head; whereas in the return stroke the extractor organ does not interfere with the feeding disk, leaving it free to rotate to bring a new product to the transfer station.

Known wrapping machines are generally bulky and complex and often have limited productivity.

In the specific case of products of the candy type, moreover, wrapping with the related wrapping sheet is difficult or imprecise, or in any case not very flexible, due to the difficulty in correctly manipulating the candies. It should be noted that the candies are usually gripped by the pincers of the wrapping head in correspondence with the flanks, i.e. on the narrowest part, with obvious grip difficulties especially for products with particular shapes, for instance lenticular.

Another problem encountered in machines for wrapping the aforementioned products is constituted by the difficulty of assuring the environmental hygiene necessary to the products themselves, for instance due to the leakage of noxious substances (in particular lubricating oil and the like) from moving organs, which generally are positioned above the feeding disks.

SUMMARY OF THE INVENTION

The task of the present invention is to solve the aforementioned problems, devising an apparatus for wrapping confectionery products, in particular candies and the like, designed in such a way as to effect the enveloping of the products in optimal fashion, assuring complete environmental hygiene and giving the various organs the time required to perform their functions appropriately, to the advantage of productivity.

Within the scope of this task, a further aim of the present invention is to make available an apparatus for wrapping products of the aforementioned kind which presents a high simplicity and economy of construction, and which offers the guarantee of a certainly reliable operation and a versatile employment, in particular facilitating format changes.

This task and this aim are both achieved, according to the invention, by the present apparatus for wrapping confectionery products and the like, comprising a device for feeding the products to be wrapped, an organ for extracting said product from said feeding device able to co-operate with a device for dispensing a piece of material in sheet form, a wrapping head with pincers, rotating according to a horizontal axis to bring said products with a respective piece of material in sheet form in correspondence with a series of operative stations, wherein said feeding device comprises a circular disk, positioned horizontal and rotating about a vertical axis, which presents, peripherally distributed, a series of recesses for receiving respective products, open outwards, each provided, in correspondence with the lower surface of said disk and posteriorly thereto, with a related slit; and an annulus, fastened to the structure of the apparatus, positioned below said rotating disk for supporting said products introduced into said recesses, able partially to hide said slit of said recesses during the feeding phase and so shaped as to distance itself from the rotating disk, in correspondence with a station for transferring the individual products to be wrapped to the wrapping head, to render visible said slit during the transfer phase and allow means for thrusting said extractor organ to transit through it.

BRIEF DESCRIPTION OF THE DRAWINGS

The details of the invention shall become more readily apparent from the detailed description of a preferred embodiment of the apparatus for wrapping confectionery products and the like, illustrated by way of indication in the accompanying drawings, in which.

DESCRIPTION OF THE PREFERRED EMBODIMENT

Figure 1:
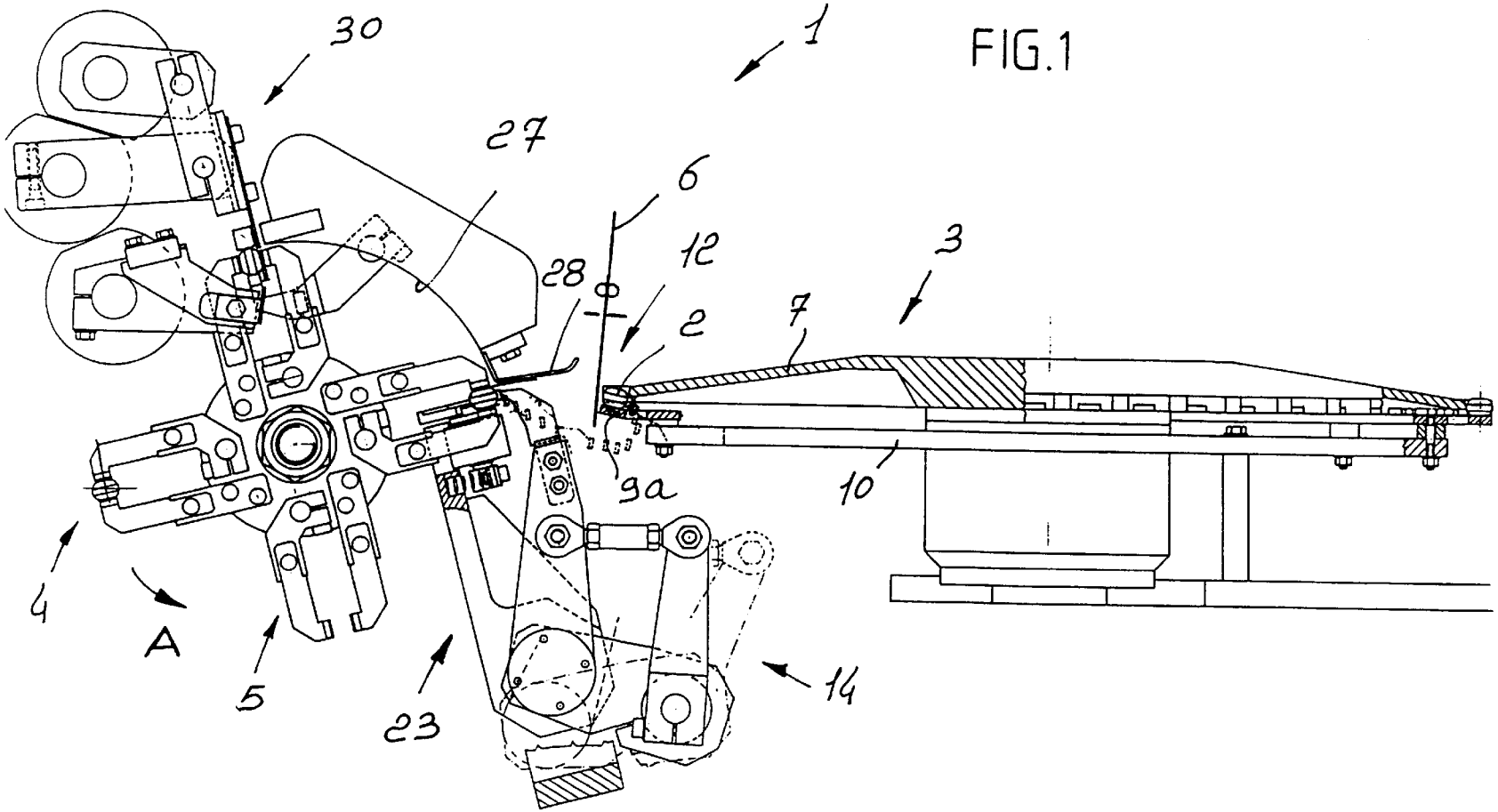
FIG. 1 shows a global side view of the subject apparatus.

With particular reference to the aforesaid figures, the reference number 1 indicates in its entirety the apparatus for wrapping the confectionery products 2, for instance of the candy type.

The apparatus 1 comprises a device 3 for feeding the products 2 to be wrapped. The device 3 is able to feed a wrapping head 4 with pincers of the apparatus, rotating intermittently according to the direction A about a horizontal axis. In particular the wrapping head 4 with pincers comprises four operative stations, as specified hereafter.

Figure 2:
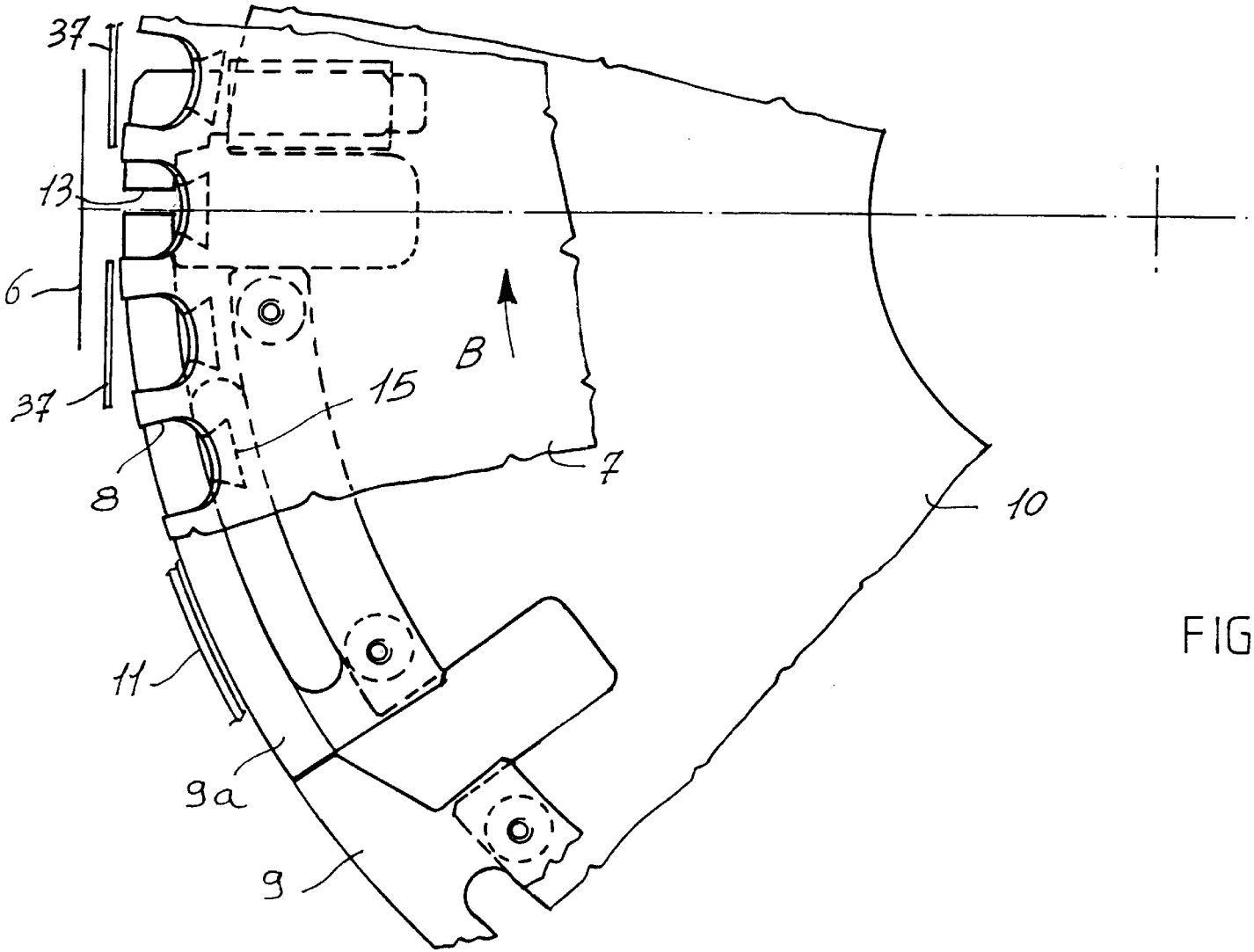
FIG. 2 shows an enlarged plan view of a portion of the aforesaid feeding device, in correspondence with the station for transferring the products to be wrapped.

The feeding device 3 prepares the introduction into a set of pincers 5, arrived open at a first of such stations of the wrapping head 4, of a product 2 and of a related piece 6 of wrapping material in sheet form (see FIGS. 1 and 2).

The feeding device 3 comprises a circular disk 7, positioned horizontally and rotating about a vertical axis, according to the direction B. The disk 7 presents, peripherally distributed, a series of recesses 8 for receiving respective products 2.

The recesses 8 are open upwardly and outwardly, and are shut inferiorly by an annulus for supporting the products 2, formed by successive annulus segments 9, 9*a* fastened to the structure 10 of the apparatus. The products 2 reach the recesses 8 by means of the disk 7 which, in order to favor the distribution of the products 2, has its upper surface provided with a slightly weathered profile. The products 2 inserted into the recesses 8 are further held by a side panel 11 positioned externally to the disk 7.

The side panel 11 presents an opening in correspondence with a station 12 for transferring the products 2 to the wrapping head 4 fitted with pincers.

In correspondence with the transfer station 12, the annulus 9*a* is so shaped as to distance itself progressively from the disk 7, forming a sort of helix. The annulus 9*a* also has an upwardly folded edge, in correspondence with the area involved by the recesses 8 of the disk 7 (see in particular FIG. 4). In practice the folded edge of the annulus 9*a* forms such an angle as to be normal to the organs tasked with extracting the products 2, better specified farther on in the description. In addition to allowing for a better containment of the products 2, the folded edge of the annulus 9*a* performs the function of allowing the product to be extracted to present itself perpendicular to the aforesaid extracting organs, i.e. parallel to the grip axis.

The annulus 9*a* further presents an opening 13, practically radial, able to allow the passage of the support arm 16 of an extractor organ 14 destined to effect the withdrawal and transfer of the products 2.

Figure 3:
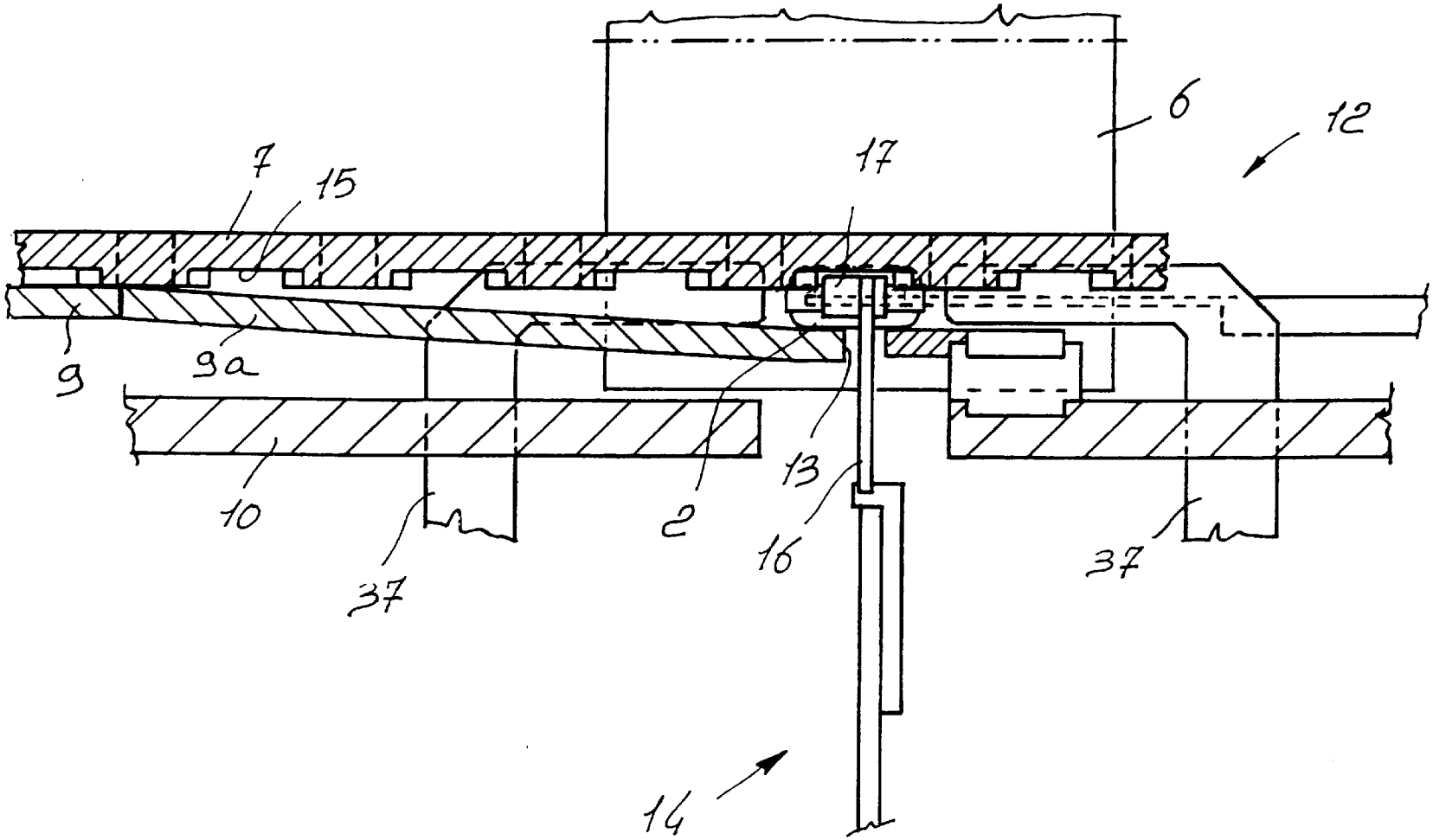
FIG. 3 shows a section view of this portion of the feeding device.

The disk 7 presents on its lower surface, in correspondence with each of the recesses 8 and posteriorly thereto, a related slit 15, suitably widened posteriorly (FIGS. 2 and 3).

The extractor organ 14 is movable on a vertical plane, substantially radial to the disk 7 of the feeding device 3, in such a manner as to traverse, during an active stroke, the aforesaid opening 13 of the annulus 9*a* of the feeding device 3 and said slit 15 of the disk 7.

Figure 4:
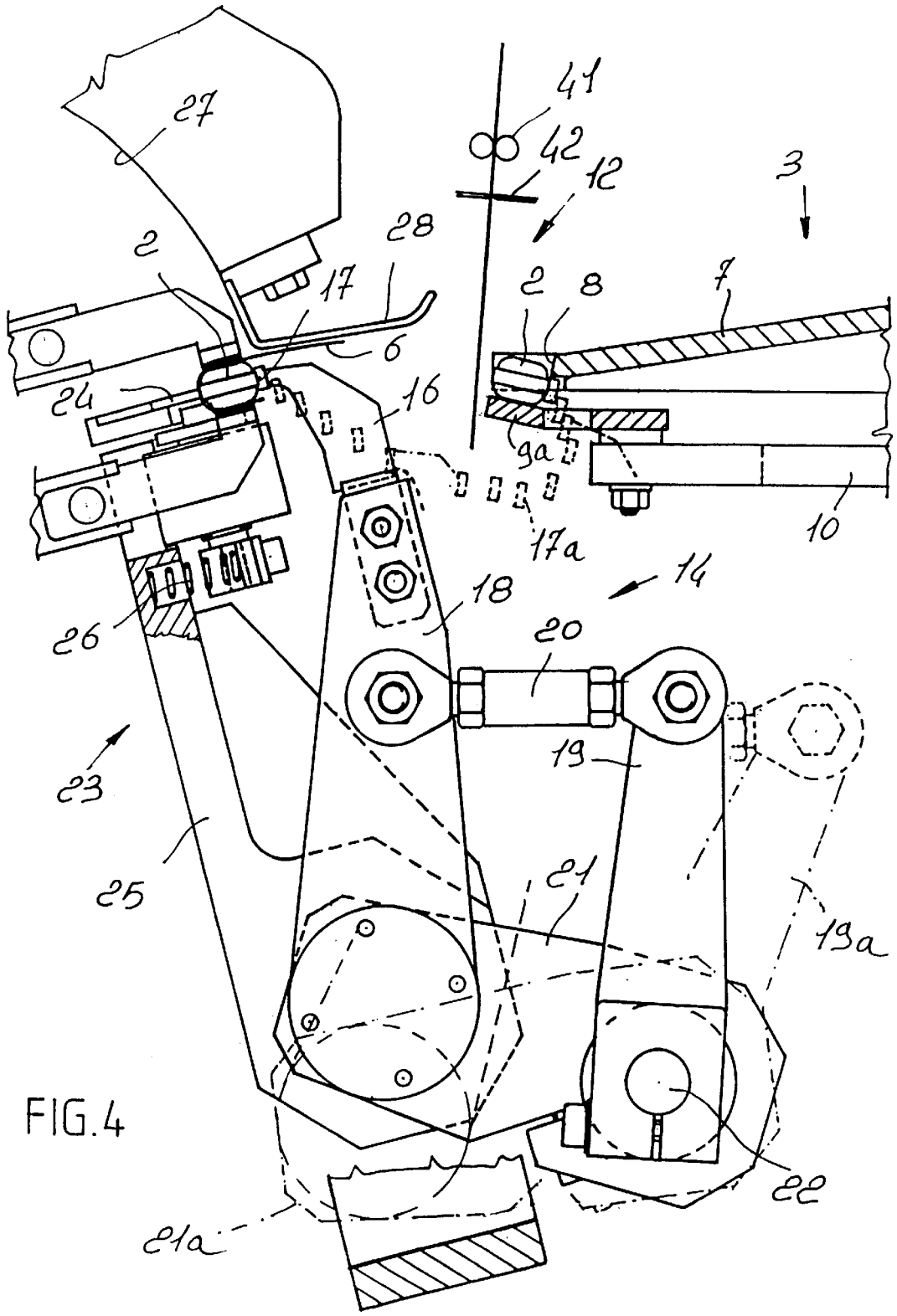
FIGS. 4 and 5 show a side view of the apparatus in correspondence respectively with the aforementioned transfer station and with a subsequent product wrapping station.

The extractor organ 14 is constituted by the aforementioned support arm 16, which is flattened on the aforesaid vertical plane and bears at its summit a thruster shaped by a head 17 (FIG. 4). The arm 16 is actuated by means of an articulated quadrilateral constituted by a first rocker arm 18, whereto the arm 16 is fastened, and by a second rocker arm 19, mutually articulated by means of a tie rod 20, and by a crank 21 which at one end bears, articulated, the first rocker arm 18 and at the opposite end is pivotingly engaged in axis to the pivot pin 22 of the second rocker arm 19.

The aforementioned articulated quadrilateral is actuated by a cam device, not shown, by effect whereof the extractor organ 14 moves, during the active stroke, between a retracted position and an advanced position, shown with continuous line in FIGS. 1 and 4; the retracted position is determined by the rotation of the rocker arm 19 and of the crank 21 in the positions indicated with the dashed lines 19*a* and 21*a*.

With the thruster 17 of the extractor organ 14 co-operates an auxiliary gripping organ 23 constituted by a bracket 24 which is pivotingly and elastically engaged to the summit of an arm 25, able to swivel according to the axis of rotation 40 of the first rocker arm 18 when the latter is in the advanced position. The bracket 24 is stressed by a string 26.

The extractor organ 14 is able to co-operate with a device, not shown, for dispensing the aforesaid piece 6 of material in sheet form, for the transfer of the product 2 and of the piece 6 of material in sheet form, which partially envelops the same product 2 during the transfer, to a corresponding set of pincers 5 of the wrapping head 4, which preserves the envelopment. The material in sheet form unwinds, in a known manner, from a reel, downstream whereof are positioned suitable cutting organs.

Between the first station of the wrapping head, corresponding to the aforesaid transfer station 12, and the second station, a fixed folding organ 27 develops, presenting an active surface shaped substantially according to an arc of circumference. The folder 27 bears integral to the lower end a lamina 28 able to act on the upper margin of the piece 6 of material in sheet form.

The folder 27 and the lamina 28 co-operate to determine the partial winding of the piece 6 of material in sheet form onto the product 2 to be wrapped during the transfer.

Figure 5:
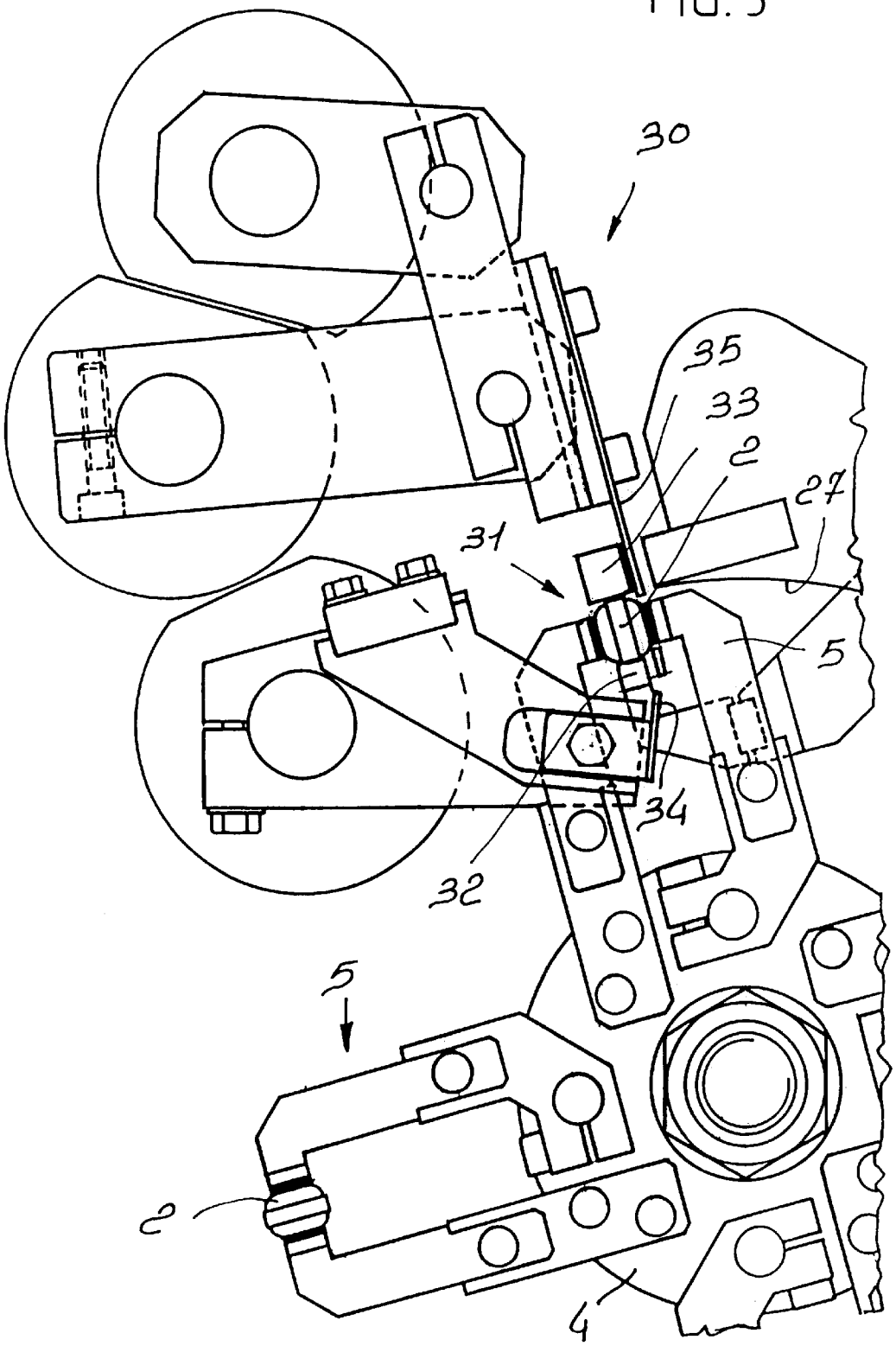

In correspondence with the aforementioned second station of the wrapping head 4 operates a device for enveloping the product 2 with the piece 6 of material in sheet form 2, indicated globally by the reference 30 (see in particular FIG. 5).

The enveloping device 30 comprises an auxiliary organ 31 for gripping the product 2 partially enveloped with the piece 6 of material in sheet form, constituted by a movable jaw 32 and by a fixed check 33. With the auxiliary gripping organ 31 co-operate a pair of tongues 34, destined to hold the edge of the piece 6 of material in sheet form in the enveloping configuration, and a movable folder organ 35, able to be actuated according to a direction substantially radial to the wrapping head 4 by suitable actuating organs; the tongues 34 are in turn movable between a lowered disengaged position and an active position raised to the level of the pincers 5 for gripping the product 2 partially enveloped with the piece 6 of material in sheet form.

Figure 6:
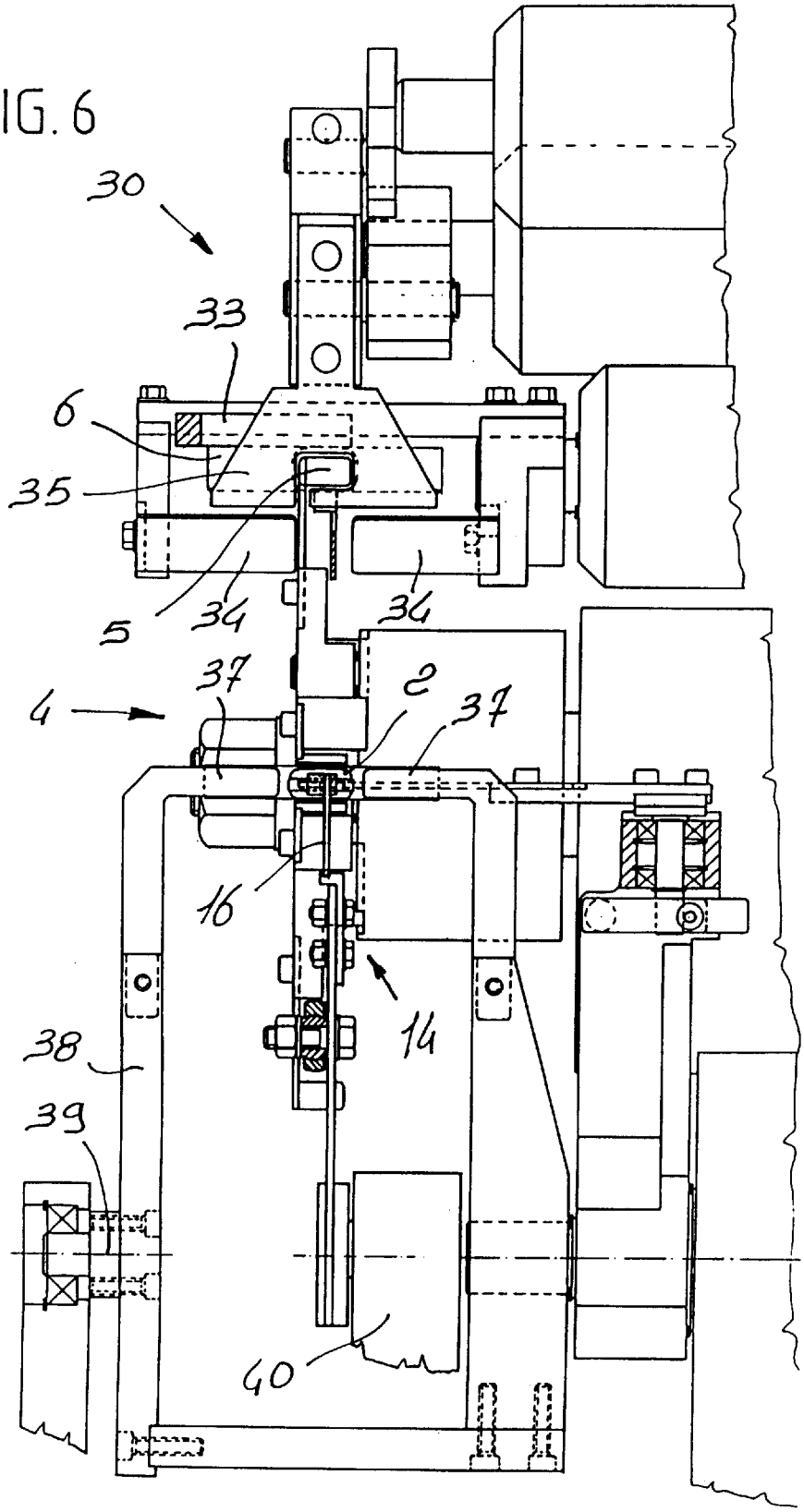
FIG. 6 shows an elevation view, from the front, of the wrapping head of the apparatus.
Figure 7:
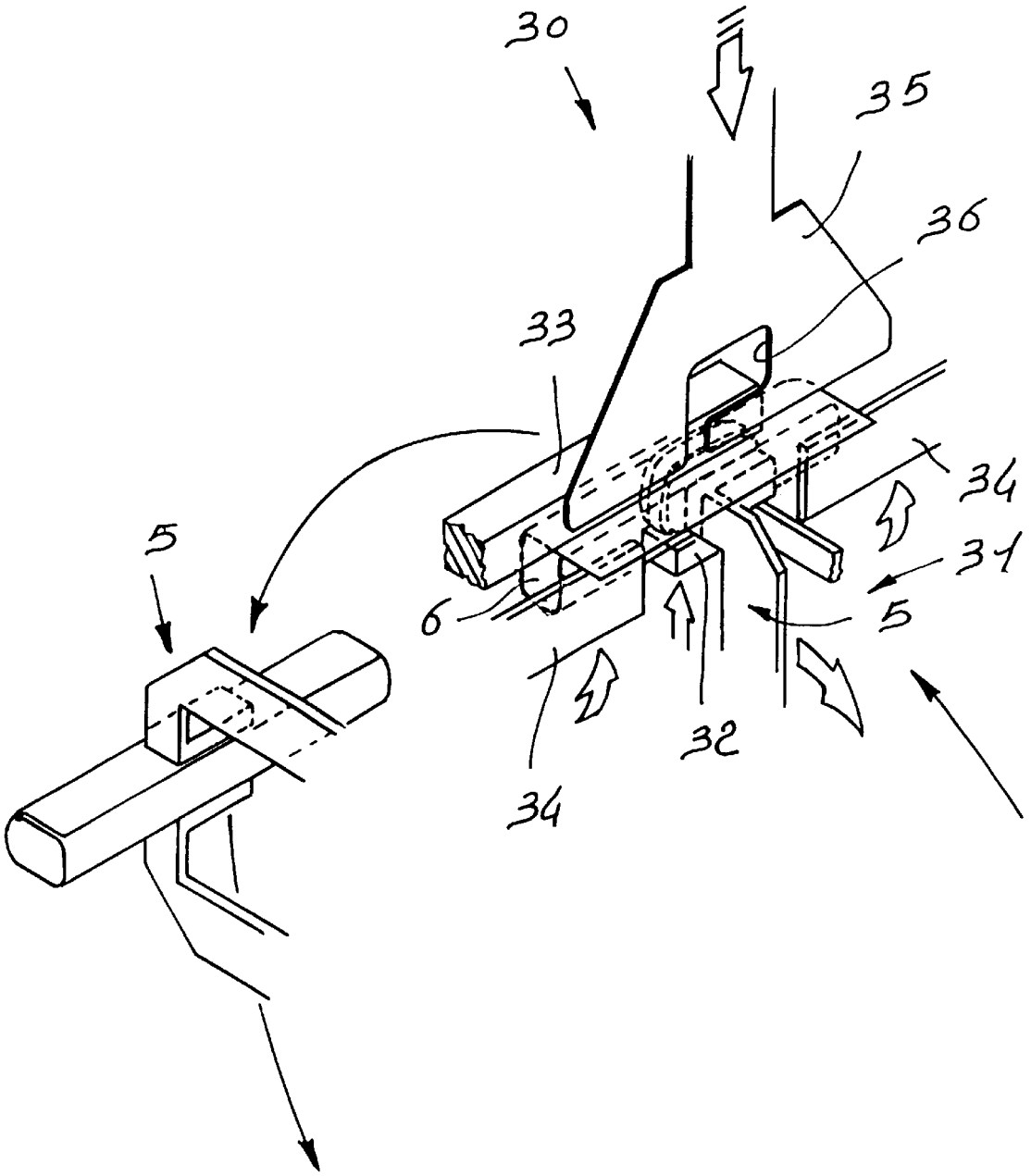
FIG. 7 shows a schematic perspective view of the aforesaid product wrapping station.

The movable folder 35 has laminar shape and presents in central position a slot 36 open downwards, able to allow the passage of a corresponding jaw of the aforesaid pincers 5 of the wrapping head 4 (FIGS. 6 and 7).

Depending on the type of material in sheet form used for the wrapping, for instance extremely light material, it is further possible to envision the employment of organs accompanying the piece 6 of material in sheet form on the product 2 at the entry into the pincers 5 of the wrapping head 4.

Such accompanying organs substantially comprise a pair of shaped tongues 37 borne at the ends of a fork frame 38, in such a manner as to engage the end portions of the piece 6 of material in sheet form partially enveloping the product 2 during the transfer (FIG. 6). The frame 38 oscillates on a horizontal axis 39, transverse to the longitudinal vertical plane, on command from suitable actuating organs, in synchrony with the movement of the extractor organ 14 and of the auxiliary gripping organ 23. The aforesaid axis 39 coincides with the axis 40 of the rocker arm 18 of the extractor organ 14 when the latter is in the advanced position.

The operation of the described apparatus is as follows.

The products 2 to be wrapped, positioned in the recesses 8 of the rotating disk 7 of the feeding device 3, are transported in succession to the transfer station 12.

The individual products 2 are drawn by the extractor organ 14, co-operating with the auxiliary gripping organ 23, and transferred between the jaws of the pincers 5 of the wrapping head 4 stopped in correspondence with the aforesaid transfer station 12. The arm 16 of the extractor 14 traverses in its active stroke the opening 13 provided for this purpose on the fixed annulus 9*a* of the feeding device 3, in correspondence with the recess 8 of the rotating disk 7 slowing in the station 12; the thruster 17 instead traverses the slit 15 obtained on the rotating disk 7, posteriorly to the corresponding recess 8, made visible by the shape of the annulus 9*a*.

It should be stressed that the inclined edge of the annulus 9*a* causes the product to be extracted to present itself parallel to the grip axis of the thruster 17.

It should further be stressed that the time taken by the thruster 17 of the extracting organ to traverse the slit 15 is very short, so that said traversing does not influence the rotation of the disk 7.

In the return stroke instead the extractor 14 moves back behind the successive recess 8. In FIG. 4, the sequential traces indicated as 17*a* show the trajectory of the thruster 17 of the extractor organ 14 during the return stroke, by effect of the combined movement of the rocker arms 18, 19 and of the crank 21.

During the aforementioned active stroke, the product 2 drawn by the extractor organ 14 strikes a related piece 6 of material in sheet form. The coordinated rotation of the auxiliary gripping organ 23 determines the fastening of the drawn product 2 and of the piece 6 of material in sheet form between the aforementioned thruster 17 and the bracket 24 of the organ 23.

It should be noted that the product 2 strikes with its flank, i.e. with its narrowest part, the piece 6 of material in sheet form which hence partially envelops the product itself. This partial envelopment is asymmetrical, as a result of the advance imparted to the second piece 6 of material in sheet form.

The product 2 and the piece 6 of material in sheet form are thus transferred to the pincers 5 of the wrapping head 4, possibly with the aid of the accompanying organs 37, and then released by the extractor organ 14 and by the auxiliary gripping organ 23.

It should be stressed that the product 2 is gripped by the jaws of the pincers 5 in correspondence with its mutually opposite flattened faces, condition which is also optimal for the subsequent manipulation of the product itself; in particular the product is tightly secured during the wrapper twisting phase.

The actuation in rotation of the wrapping head 4 subsequently determines the passage of the product 2 with the piece 6 of material in sheet form in the second operative station, in correspondence with which the enveloping by the device 30 of the product 2 with the piece 6 of material in sheet form is completed. During this passage phase, the fixed folder 27 effects the partial envelopment of the product 2 with the piece 6 of material in sheet form.

As shown for the sake of greater clarity in FIG. 7, in the second operative station on the product 2 partially enveloped act, in ordered sequence, the auxiliary gripping organ 31, constituted by the movable jaw 32 and by the fixed check 33, the pair of tongues 34 destined to hold the edge of the piece 6 of material in sheet form in the wrapped configuration and the movable folder organ 35.

More in particular, the product 2 is gripped by the auxiliary gripping organ 31 in such a way as to allow its release by the pincers 5, whilst the tongues 34 hold the enveloping segment of the piece 6 of material in sheet form. The descent is then commanded of the movable folder 35 which wraps the open segment of the piece 6 of material in sheet form. The enveloped product 2 is then again gripped by the pincers 5 of the wrapping head 4, thanks to the slot 36 of the movable folder 35 which allows the passage of the pincers 5; the tongues 34 are extracted and the auxiliary gripping organ 31 is released. It should be noted that the gripping organ 31 grips the product 2 in correspondence with the flanks.

The subsequent rotation of the wrapping head 4 determines the passage of the product 2 into a third station, where the closure of the wrapping is completed in a known manner, and then into a fourth station where the wrapped product is released by means of ejector organs to be sent to the subsequent packaging phases. It should be stressed that all four stations are operative.

The described apparatus achieves the aim of effecting in optimal fashion the wrapping of confectionery products such as candies and the like. In particular, the apparatus is so designed as to give the various organs sufficient time to perform their functions appropriately to the advantage of productivity.

It should be highlighted that the transfer of the product from the rotating disk of the feeding device to the wrapping head, together with the related piece of material in sheet form, takes place with the same product gripped in its wider part and that during the transfer the tubular wrapping is formed on the narrower part of the product, thereby offering less air resistance and facilitating the perfect formation of the complete tubular wrapping. A further advantage deriving therefrom is given by the possibility of using ever lighter materials in sheet form, with sure productive savings.

The fact that the product is gripped by the pincers of the wrapping head in correspondence with the opposite faces, and not of the flanks as normally takes place in traditional wrapping machines for hard candies, obviously facilitates the grip, which is particularly important during the subsequent wrapper twisting phase, the most demanding for the product. The advantage is relevant particularly with disk or oval-shaped products, as are the most widely produced candies.

Moreover, the apparatus presents a high degree of environmental hygiene since all moving organs are placed laterally and inferiorly to the rotating disk of the product feeding device, so that any leakage of noxious substances cannot pollute the products, as yet not wrapped. The feeder set for the material in sheet form is mounted in the vertical position, with the sheet outside the rotating disk.

In the practical embodiment of the invention, the materials used as well as the form and dimensions may be any, according to needs.

What is claimed is:

1. An apparatus for wrapping confectionery products and the like, comprising a device for feeding the products to be wrapped, an organ for extracting said products from said feeding device able to co-operate with a device for dispensing a piece of material in sheet form, a wrapping head with pincers, rotating according to a horizontal axis to carry said products with a respective piece of material in sheet form in correspondence with a series of operative stations, wherein said feeding device comprises a circular disk, positioned horizontal and rotating about a vertical axis, which presents, peripherally distributed, a series of recesses for receiving respective products, open outwards, each provided, in correspondence with a lower surface of said disk and posteriorly thereto, with a relative slit; and an annulus, fastened to the structure of the apparatus, positioned below said rotating disk for supporting said products introduced into said recesses, able partially to hide said slit of said recesses during the feeding phase and so shaped as to distance itself from said rotating disk, in correspondence with a station for transferring the individual products to be wrapped to said wrapping head, to make said sift visible during the transfer phase and allow a thruster of said extractor organ to transit through it, between the disk and the annulus.

2. An apparatus as claimed in claim 1, wherein said annulus comprises, in correspondence with said product transfer station, an upwardly folded edge, forming such an angle as to position the product to be extracted parallel to the grip axis of said thruster means.

3. An apparatus as claimed in claim 1, wherein said annulus presents, in correspondence with said station for extracting the products, an opening able to allow the passage of a support arm, of flattened shape, of said extractor organ, according to a direction substantially radial to said rotating disk.

4. An apparatus as claimed in claim 1, comprising, in correspondence with a second operative station of said wrapping head, positioned downstream of said product transfer station, a device for enveloping the related product with said piece of material in sheet form, comprising an auxiliary organ for gripping said partially enveloped product, able to grip the same product in correspondence with the flanks; a pair of tongues destined to hold the edge of said piece of material in sheet form in the enveloping configuration while completing the enveloping of said product; and a movable folder organ able to be actuated according to a direction substantially radial to said wrapping head, to complete the enveloping of said piece of material in sheet form on said product.

5. An apparatus as claimed in claim 4, wherein said movable folder organ has laminar shape and present in central position a slot open downwards, able to allow the passage of a corresponding set of pincers of said wrapping head, in a median position to said tongues.

6. An apparatus as claimed in claim 1, comprising, in correspondence of said transfer station, means for accompanying said piece of material in sheet format on the related product at the entry into a corresponding pincers set of said wrapping head, provided with a pair of shaped tongues borne at the end of a fork frame, in such a way as to engage the end portions of said piece of material in sheet form partially enveloped on said product, said frame being able to oscillate on a horizontal axis, transverse to the longitudinal vertical plane, in synchrony with the movement of said extracting organ.

7. An apparatus as claimed in claim 6, wherein said horizontal axis of said frame bearing said shaped tongues is aligned with the angular axis of rotation of thruster means of said extractor organ, during the product transferring phase.

* * * * *

UNITED STATES PATENT AND TRADEMARK OFFICE

CERTIFICATE OF CORRECTION

PATENT NO. : 6,487,832 B1
DATED : December 3, 2002
INVENTOR(S) : Salicini, Sandro It is certified that error appears in the above-identified patent and that said Letters Patent is hereby corrected as shown below:

Title page,
Item [73], Assignee, should be changed from:
"Bugnion S.p.A., Bologna (IT)"
to
-- A.M.S. S.r.l., Bologna (IT) --

Signed and Sealed this

Twentieth Day of May, 2003

JAMES E. ROGAN
*Director of the United States Patent and Trademark Office*